United States Patent [19]

Kluppel

[11] Patent Number: 4,657,070

[45] Date of Patent: Apr. 14, 1987

[54] AIR-COOLED VAPOR CONDENSERS

[75] Inventor: George E. Kluppel, Houston, Tex.

[73] Assignee: Hudson Products Corporation, Houston, Tex.

[21] Appl. No.: 580,191

[22] Filed: Feb. 15, 1984

[51] Int. Cl.[4] ..... F24B 1/06

[52] U.S. Cl. ..... 165/124; 165/110; 165/900

[58] Field of Search ..... 165/122, 124, 126, 110, 165/128, 130, 131, 900

[56] References Cited

U.S. PATENT DOCUMENTS

| | | | |
|---|---|---|---|
| 1,929,618 | 10/1933 | Wentworth | 165/128 |
| 2,214,057 | 9/1940 | Hull | 165/124 X |
| 3,939,906 | 2/1976 | Rothenbucher | 165/124 X |
| 4,144,933 | 3/1979 | Asselman et al. | 165/124 |
| 4,401,154 | 8/1983 | Anders et al. | 165/124 X |

FOREIGN PATENT DOCUMENTS

| | | | |
|---|---|---|---|
| 634514 | 1/1933 | Fed. Rep. of Germany | 165/128 |
| 2345853 | 9/1973 | Fed. Rep. of Germany | 165/124 |
| 2531552 | 2/1976 | Fed. Rep. of Germany | 165/128 |
| 763554 | 3/1934 | France | 165/128 |

*Primary Examiner*—Albert W. Davis, Jr.
*Assistant Examiner*—Peggy Neils
*Attorney, Agent, or Firm*—Vaden, Eickenroht, Thompson & Boulware

[57] ABSTRACT

There is disclosed an air-cooled vapor condenser having tube bundles mounted over the open end of the fan ring of an axial flow fan with their axes of the tubes inclined with respect to the direction of air flow and fins on the tubes which extend parallel to the direction of air flow.

5 Claims, 5 Drawing Figures

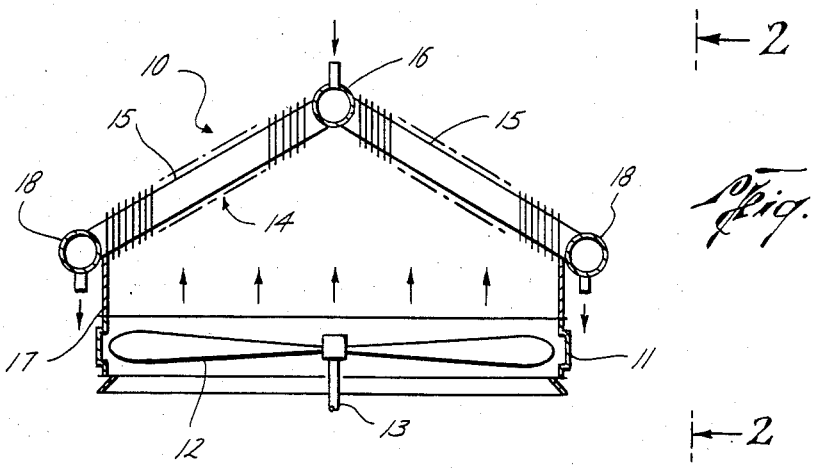
Fig. 1
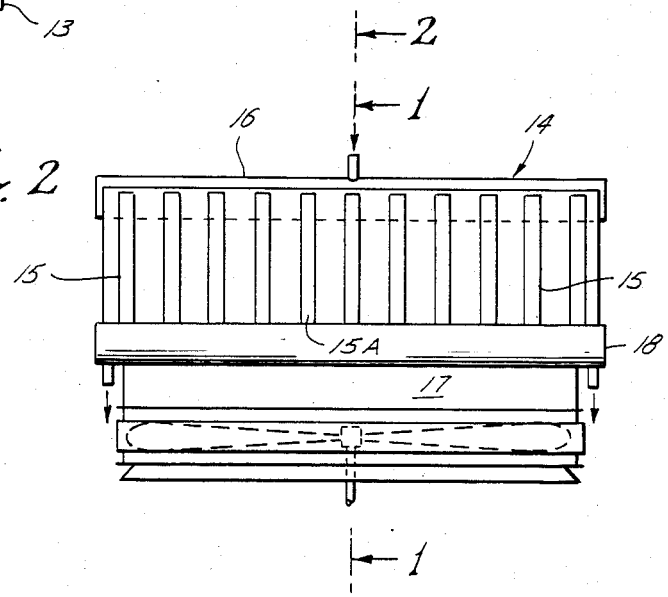
Fig. 2
Fig. 3
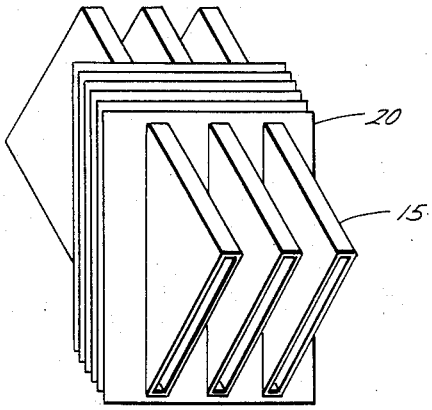
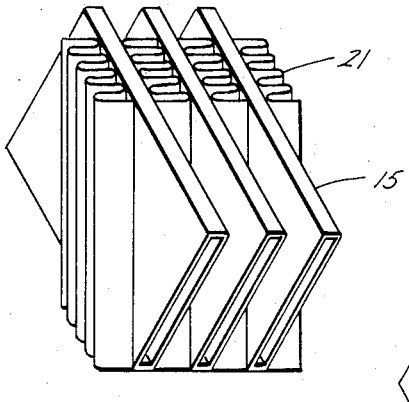
Fig. 4
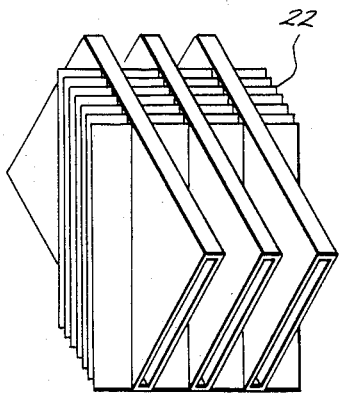
Fig. 5

AIR-COOLED VAPOR CONDENSERS

This invention relates to improvements in air-cooled vapor condensers in which vapor such as steam is passed through the tubes of one or more bundles of tubes which are disposed across one end of a fan ring of an axial flow fan to cause the vapor to be condensed as air from the fan flows therepast.

In many such condensers, the fan is supported with its axis of rotation perpendicular to the horizontal and the axes of the tubes of the bundle or bundles are inclined with respect to the horizontal to dispose one end above the other in order that condensate may flow downwardly therethrough. There may be two such bundles arranged end-to-end and extending in opposite directions to form a "V" between them. For example, the bundles may be arranged as an inverted "V" above a forced draft fan, with vapor being introduced into the upper ends of the tubes at the apex of the "V" and drained from their lower ends.

Ordinarily, each bundle comprises two or more parallel rows of tubew with headers at each end thereof providing common steam inlets and common condensate outlets. However, as disclosed in U.S. Pat. No. 4,168,742, each bundle may consist of only a single row of tubes, with each such tube being in the form of an elongate "box" having parallel side walls which extend in the direction of air flow therepast and which are considerably longer than the width of the tube.

It is also standard practice to provide such tubes with fins which extend their outer surfaces and thereby increase their abilities to exchange heat—i.e., cool the vapor. These fins may be discrete in the sense that each tube has its own fin, or the fins may comprise plates which are common to the tubes which extend through them. Or, as shown in the aforementioned patent, the fins may extend between and thus be common to the side walls of adjacent tubes, whether in the form of individual fins, plates, or pleats which are folded back and forth between the tubes.

In any event, the fins conventionally extend perpendicularly to the axes of the tubes, which, of course, facilitate the mounting of discrete fins which are wrapped about the tube or extruded from the tube surface, or, for that matter, which comprise discs or plates having holes which are slid over and then attached about the tube. When, however, bundles of such finned tubes are mounted in an air-cooled steam condenser of the type above described, air from the fan must change direction or bend in order to flow between the fins and thus past the tubes. This, of course, calls for the supply of considerable energy or power to the fan, particularly when, as is normally the case, the fins are inclined at an angle of sixty degrees (60°) or more with respect to the vertical, and are spaced apart as little as 0.08 inches.

The primary object of this invention is to provide an air-cooled vapor condenser of the type described which enables the fan to be operated with less power, and, more particularly, which permits the air to flow past the finned tubes thereof without bending.

A more particular object is to provide such a vapor condenser for which the aforementioned "box" type finned tubes are particularly well suited.

These and other objects are accomplished, in accordance with the illustrated embodiments of the present invention, by a vapor condenser of the type described wherein the fins extend other than perpendicularly to the axes of the tubes of each bundle on which they are mounted, and, more particularly, extend parallel to the axis of rotation of the fan and thus the direction of air flow. As illustrated, there are a pair of bundles which are of the type above-mentioned in that they are arranged end-to-end and have at least one row of such finned tubes whose axes are inclined with respect to the axis of the horizontal to dispose one end above the other, and form a "V" between them.

As also illustrated, and in accordance with the preferred embodiments of the invention, each bundle consists of only a single row of tubes of the above-described "box" shape, and thus having parallel side walls which extend in the direction of air flow therepast and which are considerably longer than the width of the tubes. In accordance with one embodiment, the fins are plates through which the tubes of each row extend. In accordance with alternative embodiments, individual fins extend between the side walls of the tubes, either as flat strips or as pleats which are folded back and forth between the side walls of the tubes.

As will be appreciated, fins of these latter types would be of the same basic construction regardless of the inclination of the tubes and thus the fins with respect to the tubes. Also, even when in plate form, the fins would merely require the forming of rectangular rather than oval-shaped holes to fit the tubes.

In the drawings, wherein like reference characters are used throughout to designate like parts:

FIG. 1 is a diagrammatic cross-sectional view of an air-cooled vapor condenser constructed in accordance with the present invention, as seen along in the plane indicated by broken lines 1—1 of FIG. 2;

FIG. 2 is a side view of the vapor condensers of FIG. 1, as seen from the broken lines 2—2 of FIG. 1; and FIGS. 3, 4 and 5 are enlarged perspective views of portions of tube bundles for the condenser having fins which are constructed in accordance with the alternative embodiments of the invention.

The vapor condenser which is shown in FIG. 1, and indicated in its entirety by reference character 10, includes a fan ring 11 which is open at both ends and adapted to be disposed in a generally horizontal position. A fan 12 is mounted in a shaft 13 for rotation about a substantially perpendicular axis, and with its blades arranged to cause the air to move upwardly through the fan ring, as indicated by the arrows in FIG. 1.

A pair of tube bundles 14 are mounted in end-to-end relation across the upper open end of the fan ring, as by means of a plenum 17, and thus in a position for air from the fan to flow therepast. As previously described, each such bundle 14 consists of a single row of tubes 15 having their axes disposed within a plane which is inclined with respect to the horizontal and thus with respect to the direction of air flow. More particularly, in the illustrated and preferred embodiment of the invention, the tubes of the bundles are inclined in opposite directions and form an inverted "V" between them.

As shown, vapor such as steam is supplied to a header 16 extending the length of the bundles and common to the upper ends of the tubes of both bundles. Condensate from the tubes of the bundles drains into headers 18 each common to the tubes of one bundle. As previously described, and as well known in the art, upon the flow of air past the tubes, the vapor is condensed within the tubes and drains downwardly therefrom into the headers 18.

As shown, and as previously mentioned, each bundle 14 consists of only a single row of tubes, and the tubes are of an elongate box shape having parallel side walls 19 which extend in the direction of air flow therepast, and which are considerably longer than the width of the tube. The advantage of bundles having a single row of tubes of this construction is known in the art, including the aforementioned U.S. Pat. No. 4,168,742, and hence the detailed interior construction of the tubes need not be described herein.

In the embodiment of the vapor condenser shown in FIGS. 1 and 2, the tubes 15 extend through holes in closely spaced-apart plate fins 20. However, in accordance with alternative embodiments of the invention, the fins may comprise pleats 21 which, as shown in FIG. 4, are folded back and forth between the sides of adjacent tubes, with the bends in the plates being welded or otherwise secured to the side walls of the tubes. In accordance with a still further embodiment of the invention, the fins may comprise individual sheets or strips 22 extending between and secured at their opposite ends to the side walls of adjacent tubes.

In each case, however, the fins, whether of plate, pleated or individual form, extend other than perpendicularly to the axis of the tubes, as is common in the art, and, more particularly, extend parallel to the direction of air flow from the fan 12. Hence, and as previously described, the air is able to flow between the fins and between the fins without bending, and thus with a minimum of power requirements. This is particularly advantageous when, as previously described, the tube bundles may be inclined at an angle aproximately sixty degrees (60°) with respect to the horizontal, so that fins perpendicular to the axis of the tubes would require that the air from the fan bend at a complementary angle, or about one hundred twenty degrees (120°). This results, of course, from the fact that the fins are spaced relatively closely to one another, and perhaps as close as 0.08 inches apart, so that no portion of the air may pass between them without bending.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An air-cooled vapor condenser, comprising a fan ring, an axial flow fan adapted to rotate within the fan ring about an axis generally perpendicular to a horizontal plane, a pair of bundles each comprising at least one row of tubes mounted across one end of the fan ring, the axes of the tubes of the bundles being inclined with respect to the horizontal plane to dispose one end thereof above the other and extending in opposite directions to form an inverted "V" there between the tubes disposed so that the fan flows air toward and over the tubes, means for introducing vapor into the upper ends of the tubes and for draining condensate from the lower ends thereof, the fins disposed parallel to the direction of flow of air from the fan.

2. A condenser of the character defined in claim 1, wherein each bundle consists of a single row of tubes, and each tube has parallel side walls which extend in the direction of air flow therepast and which are considerably longer than the width of the tubes.

3. A condenser of the character defined in claim 2, wherein the fins are sheets which extend between the side walls of adjacent tubes.

4. A condenser of the character defined in claim 2, wherein the fins are plates through which the tubes of each row extend.

5. A condenser of the character defined in claim 2, wherein the fins are pleats which are folded back and forth between the side walls of adjacent tubes.

* * * * *